US005595292A

United States Patent [19]

Bates

[11] Patent Number: 5,595,292

[45] Date of Patent: Jan. 21, 1997

[54] CARTON HAVING SHOCK-ABSORBING CARRYING HANDLE AND PACKAGE FORMED THEREFROM

[75] Inventor: Aaron Bates, Marietta, Ga.

[73] Assignee: The Mead Corporation, Dayton, Ohio

[21] Appl. No.: 368,185

[22] Filed: Jan. 4, 1995

[51] Int. Cl.[6] ..... B65D 71/20; B65D 71/28

[52] U.S. Cl. ..... 206/158; 206/428

[58] Field of Search ..... 206/140, 141, 206/142, 143, 145–158, 162, 163, 428

[56] References Cited

U.S. PATENT DOCUMENTS

| | | | |
|---|---|---|---|
| 2,723,027 | 11/1955 | Guyer | 206/428 |
| 4,222,485 | 9/1980 | Focke | 206/141 |
| 4,470,503 | 9/1984 | Stone | 206/141 |
| 4,637,515 | 1/1987 | Wilson et al. | 206/141 |
| 4,681,217 | 7/1987 | Hernandez | 206/141 |
| 4,784,266 | 11/1988 | Chaussadas | 206/434 |
| 5,000,313 | 3/1991 | Oliff | 206/140 |

FOREIGN PATENT DOCUMENTS 2057360 4/1971 France .

*Primary Examiner*—Jimmy G. Foster
*Attorney, Agent, or Firm*—Tsugihiko Suzuki

[57] ABSTRACT

A carton includes a top panel, a pair of side panels foldably joined to and extending downwardly from the side edges of the top panel, and a strap handle formed in part from the top panel and in part from the side panels. The handle extends transversely across the top panel and is joined at its opposite end portions respectively to the side panels for movement between a stowed position and a raised position. When the handle is in the stowed position, the intermediate portion of the handle is disposed in the plane of the top panel whereas when it is in the raised position, the intermediate portion of the handle is bowed and disposed above the top panel. Each end portion of the handle has a foldable tab adapted to be pressed against an article within the carton and to thereby be folded to allow gradual stress increase in the handle when the handle is pulled upward from the stowed position.

20 Claims, 7 Drawing Sheets

CARTON HAVING SHOCK-ABSORBING CARRYING HANDLE AND PACKAGE FORMED THEREFROM

BACKGROUND OF THE INVENTION

This invention generally relates to a carton having a carrying handle and more particularly to a carton having a strap handle which has great resistance to impact applied thereto when the carton is lifted by holding such a handle.

French Patent No. 6927932 discloses a carton having a strap handle, which carton includes a pair of side panels foldably joined to top and bottom panels to form a tubular structure for accommodating a group of articles. The strap handle is struck in part from the top panel and in part from the side panels so that it extends across the top panel and is joined at its opposite ends to the side panels. One problem with this type of carton is its vulnerability to tearing of the handle due to impact applied to the handle when the carton is lifted by holding the handle. One solution to this problem is to form the carton from relatively thick paperboard. However, this would not be an economical solution. Another solution is to provide the handle with a reinforcement by means of flaps foldably joined entirely along the opposite side edges of the handle. Such a reinforced strap handle is described, for example, in U.S. Pat. No. 4,222,485 to Focke, wherein the reinforcing flaps are folded in superposed relationship with the handle. Although this would prevent tearing at the intermediate portion of the handle, the handle still tends to tear at either end thereof because the flaps cannot reinforce the joint region between the handle and each side panel at which stress tends to be concentrated. Attaching a separate reinforcing elements to the handle may be another solution. This would, however, cause increase in number of the carton manufacturing processes and thus would not be desirable from the view point of productivity.

What is needed, therefore, is a carton which has a strap handle having great impact strength, which is of an economical construction and which can be efficiently manufactured.

SUMMARY OF THE INVENTION

To meet the foregoing needs, the present invention in one form provides a carton which includes a top panel a pair of side panels foldably joined to and extending downwardly from the side edges of the top panel, and a strap handle formed in part from the top panel and in part from the side panels. The handle is disposed transversely of the side edges of the top panel and extends across the top panel. The opposite end portions of the handle is joined respectively to the side panels so that the handle is movable between a stowed position and a raised position. When the handle is in the stowed position, the intermediate portion of the handle is disposed in the plane of the top panel. When it is in the raised position, the intermediate portion is bowed and disposed above the top panel. Movement of the handle from the stowed position to the raised position causes its end portions to be displaced inwardly of the carton, and therefore foldable means provided for each end portion is pressed against the article packaged in the carton. As pressed against the article, the foldable means is folded to allow gradual stress increase in the handle and thereby absorbs impact applied to the handle upon lifting of the carton.

A preferred embodiment of the foldable means is a tab formed from each side panel and joined to the respective end portion for outward folding movement in respect with that end portion upon movement of the strap handle toward the raised position. Each end portion of the handle is defined between a pair of opposed slits formed in the adjacent side panel which slits extend downwardly from the adjacent side edge of the top panel. In a preferred embodiment, the tab is defined between a fold line in each end portion and one of the slits in the adjacent side panel. In an alternative embodiment, each end portion of the handle has an aperture for receiving a top portion of the article, and the tab of each end portion is formed of material struck from that end portion to form the respective aperture.

The present invention in another form provides a package formed using the carton described above. The package includes a plurality of articles arranged into a group of at least one row and the carton disposed around the exterior of the group of article. Each article has a substantially rounded side wall and the axes of the articles defined respectively by the side walls are disposed vertically and parallel to each other. The articles are accommodated by the carton such that the side panels of the carton are disposed adjacent to the side walls of the articles in the group along the opposite sides of the group and the top panel of the carton is disposed adjacent to the tops of the articles in the group. At least a part of each end portion of the handle is located midway between two adjacent articles in the group so as to allow each end portion with the foldable means to be displaced inwardly of the carton when the handle is pulled upward from the stowed position.

The present invention in still another form provides a carton including a top panel, a pair of side panels foldably joined to and extending downwardly from the side edges of the top panel, and a strap handle formed in part from the top panel and in part from said side panels. The handle extends transversely across the top panel and is joined at its opposite end portions respectively to the side panels. The intermediate portion of the handle is defined between a pair of opposed first slits formed in the top panel. Each end portion of the handle is defined between a pair of opposed second slits formed in the adjacent side panel. The second slits in each side panel are continuous respectively with the first slits and extend generally downwardly from the adjacent side edge of the top panel. Each side panel is provided with a pair of third slits disposed at a lateral space respectively from said second slits in that side panel. The third slits in each side panel extend to their respective lower ends remoter from the adjacent side edge of the top panel than the lower ends of the second slits in the same side panel. The lower ends of the second slits in each side panel are curved so as to be directed respectively to the third slits in the same side panel whereby when the handle is pulled upward, each second slit tends to tear into the adjacent third slit.

The present invention further provides a blank for forming the carton described in the immediately preceding paragraph.

Other objects and advantages of the present invention will be apparent from the following description, the accompanying drawings, and the appended claims.

DETAILED DESCRIPTION OF THE PREFERRED EMBODIMENTS

Figure 1:
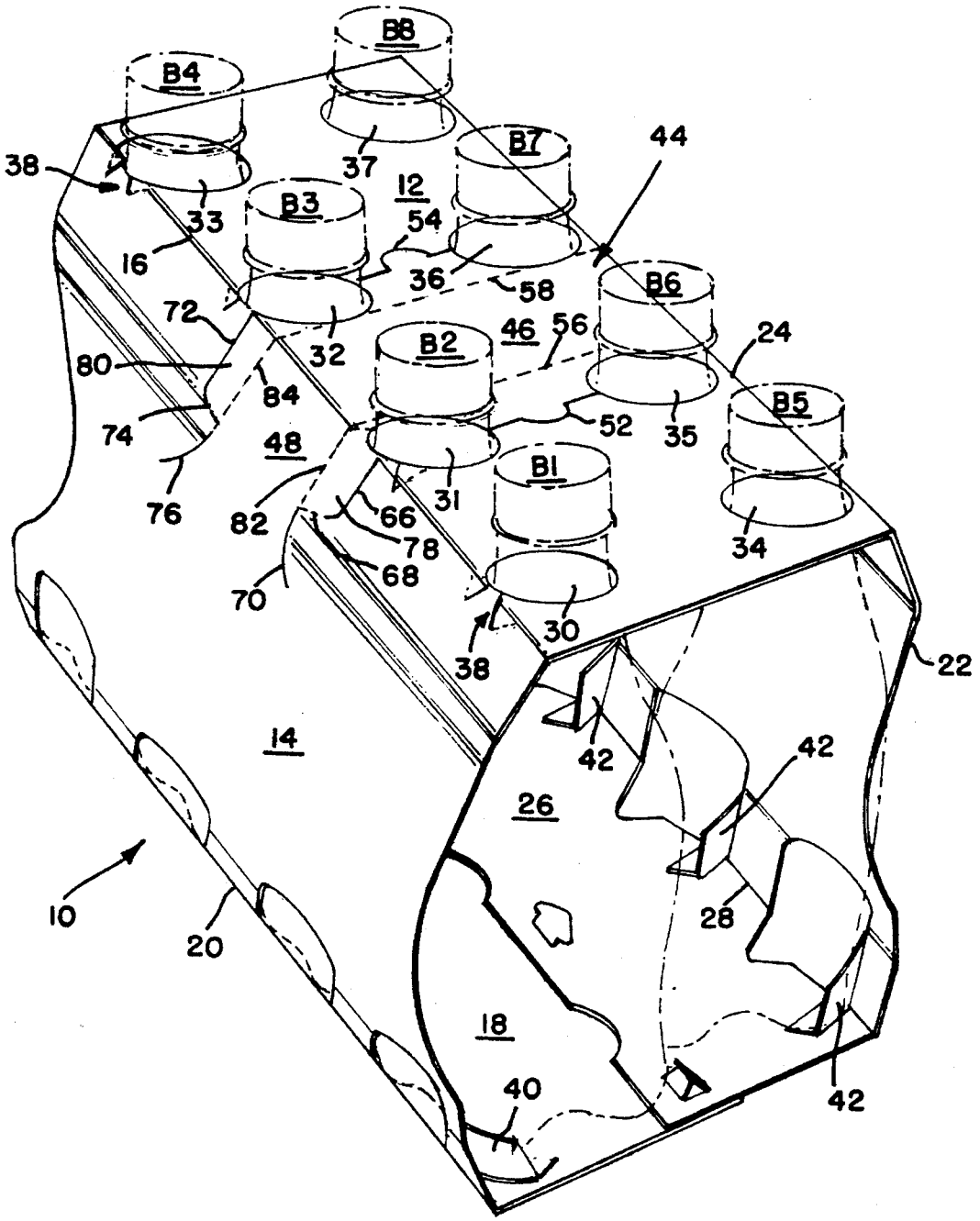
FIG. 1 is a perspective view of a carton according to the invention.

FIG. 1 illustrates a wrap-around carton 10 having an open-ended tubular construction, which accommodates a plurality of bottles. As depicted in broken lines in FIG. 1, eight bottles B1–B8 are arranged in two rows of four bottles each and are disposed within the carton 10 with their longitudinal/center axes vertical and in parallel relation to each other.

The carton 10 includes a top panel 12 horizontally disposed near the tops of the bottles B1–B8. The top panel 12 has a plurality of bottle neck receiving apertures 30–37. The necks of the bottle B1–B8 are received in the apertures 30–37 respectively and project upwardly from the top panel 12 as is apparent in FIG. 1. A side panel 14 is foldably joined to the top panel 12 along a fold line 16 and extends generally downwardly therefrom to be disposed adjacent to the side walls of the bottles B1–B4. A bottom lap panel 18 is joined foldably to the lower edge of the side panel 14 along a fold line 20 and extends generally horizontally to underlie the bottles B1–B4. A side panel 22 is foldably joined to the top panel 12 along a fold line 24 and extends generally downwardly therefrom to be disposed adjacent to the side walls of the bottles B5–B8. A bottom lap panel 26 is foldably joined to the lower edge of the side panel 22 along a fold line 28 and extends generally horizontally to underlie the bottles B5–B8. The lap panels 18 and 26 are disposed in overlapping relationship with each other and are secured together by suitable means to maintain the carton in the tubular form. Preferred securing means for the lap panels 18 and 26 is a mechanical lock which is disclosed for example in U.S. Pat. Nos. 4,077,095 and 5,131,588 which are owned by the assignee of the invention and which are hereby incorporated by reference. However, any other suitable securing means such as an adhesive known in this art may be used instead of the mechanical lock.

The apertures 30–37 are provided at the peripheries thereof with short cuts and fold lines generally indicated at 38 which are of known construction. Also, flaps 40 and 42 are provided for the carton 10 to retain the bottom portions of the bottles B1–B8 in position. The flaps 40 (only one shown in FIG. 1) are struck in part from the bottom lap panel 18 and in part from the side panel 14, and the flaps 42 are struck in part from the bottom lap panel 26 and in part from the side panel 22. These flaps 40 and 42 are described in more detail for example in U.S. Pat. No. 4,545,485 which is owned by the assignee of the invention and which is hereby incorporated by reference.

A transverse strap handle 44 is formed in part in the top panel 12 and in part in the side panels 14 and 22. The handle 44 extends transversely across the width of the top panel 12 and is joined at its opposite ends to the side panels 14 and 22 respectively. The location of the handle 44 is such that the handle 44 is disposed midway between two intermediate pairs of bottles, i.e., one pair which consists of the bottles B2 and B6 and the other pair which consists of the bottles B3 and B7. This handle 44 is normally disposed in the stowed position as shown in FIG. 1 wherein the intermediate portion 46 of the handle 44 is disposed in the plane of the top panel 12 and the opposite end portions 48 and 50 of the handle 44 are disposed flush with the side panels 14 and 22.

Figure 2:
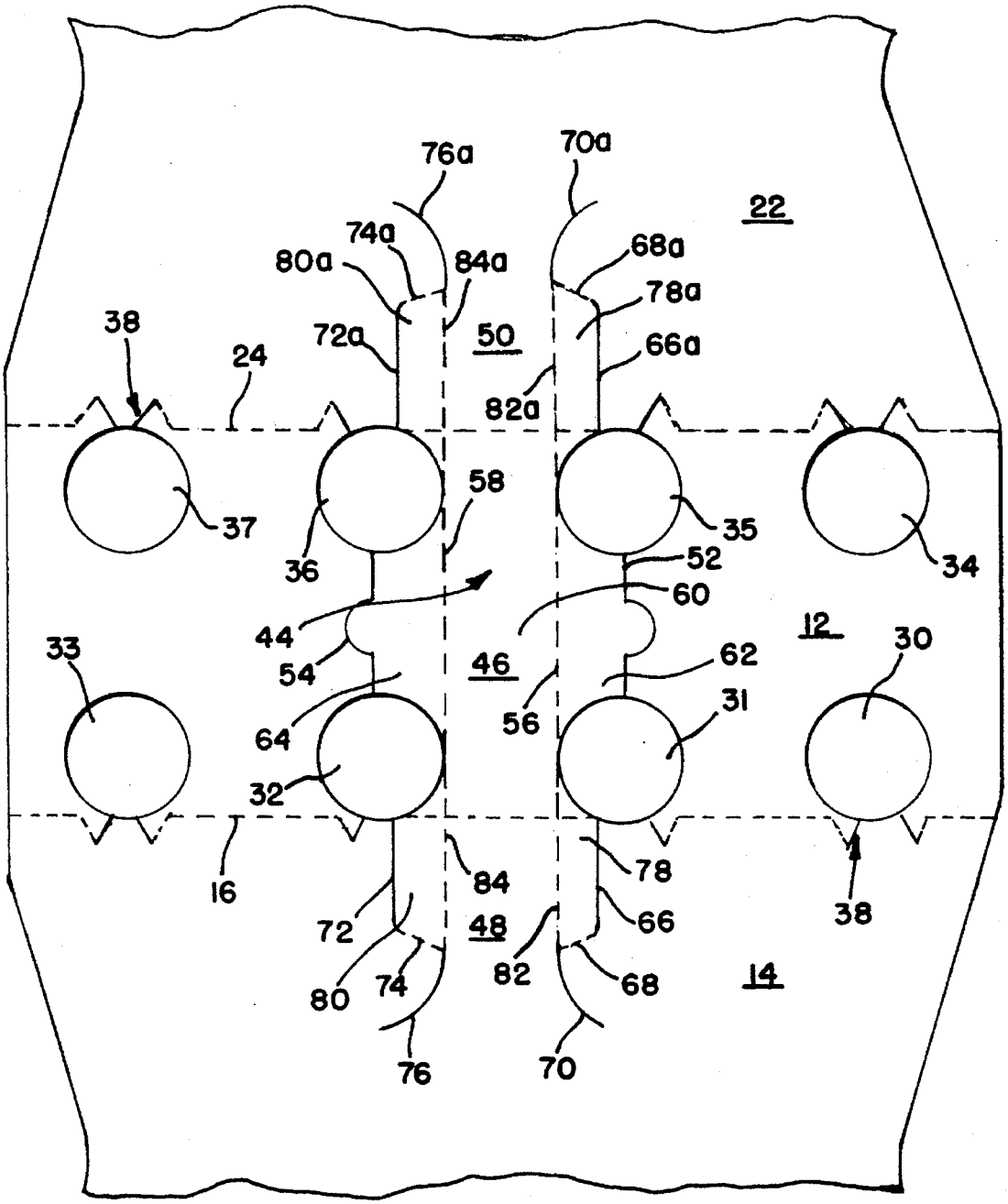
FIG. 2 is an enlarged plan view of a portion of the blank from which the carton in FIG. 1 is formed.

As best shown in FIG. 2 which illustrates a part of the carton 10 in blank form, the intermediate portion 46 is struck from the top panel 12 and is defined between a pair of spaced side edges. One of the side edges of the intermediate portion 46 is defined by a slit 52 and parts of the perimeters of the apertures 31 and 35. In other words, the slit 52 include the respective inner half perimeters of the apertures 31 and 35 and thus extends across the width of the top panel 12. In like manner, the other side edge of the intermediate portion 46 is defined by a slit 54 and the respective inner half perimeters of the apertures 32 and 36. Two medial fold lines 56 and 58 are formed in the intermediate portion 46. These medial fold lines 56 and 58 extend between the fold lines 16 and 24 and divide the intermediate portion 46 into three parts, i.e., a rectangular central part 60, a cushion flap 62 and another cushion flap 64. The flaps 62 and 64 are joined to the central part 60 along the medial fold lines 56 and 58. As will be described later, these cushion flaps 62 and 64 in use are folded inwardly of the carton and form cushions along the medial fold lines 56 and 58.

The end portions 48 and 50 of the handle 44 are struck from the side panels 14 and 22 respectively. Each end portion is defined between a pair of spaced side edges. The end portion 48 is foldably joined to the intermediate portion 46 along a part of the fold line 16, and the end portion 50 is foldably joined to the intermediate portion 46 along a part of the fold line 24. Because the end portions 48 and 50 are of a virtually identical construction, only the end portion 48 will hereinafter be described and description of the end portion 50 is omitted. The parts of the portion 50 similar to the parts of the portion 48 are identified in FIG. 1 by the same reference numerals with the subscript "a".

According to one feature of the invention, each side edge of the end portion 48 is defined by at least two separate slits that are offset from each other. In the depicted embodiment, one of the side edges of the end portion 48 is defined by a upper slit 66, a short tear line 68 and a lower slit 70. The upper slit 66 extends downwardly as viewed in FIG. 1 from the perimeter of the aperture 31 and terminates at a lower end which is curved toward the other side edge of the end portion 48. The lower slit 70 has its upper end disposed at a location laterally and inwardly offset or spaced from the lower end of the upper slit 66 and extends therefrom such that the lower end portion of the lower slit 70 is arcuately curved laterally outward of the side panel 14. The curvature of the slit 70 facilitate dispersal of stress in the side wall 14 when the carton 10 is lifted by the handle 44 and thereby to minimize the possibility of tearing of the side wall 14. The tear line 68 is formed of a plurality of perforations and extends between the lower end of the upper slit 66 and the upper end of the lower slit 70. The other side edge of the end portion 48 is defined by a upper slit 72, a short tear line 74 and a lower slit 76. These elements form a mirror image of the aforementioned one side edge of the end portion 48 and the arrangements thereof are substantially identical to the elements 66, 68 and 70 respectively.

According to another feature of the invention, the end portion 48 includes foldable means designed to absorb impact applied to the handle 44 when the handle 44 is pulled upward. In the depicted embodiment, the foldable means comprises a pair of engaging tabs 78 and 80 foldably joined to the end portion 48 along fold lines 82 and 84 respectively. More particularly, the tab 78 is defined by the slit 66, the tear line 68, the fold line 82 and a part of the perimeter of the aperture 31, and the tab 78 is defined by the slit 72, the tear line 74, the fold line 84 and a part of the perimeter of the aperture 32. The fold lines 82 and 84 are disposed in alignment respectively with the fold lines 56 and 58 in the top panel 12 and extend from the fold line 16 respectively to the upper ends of the lower slits 70 and 76.

Figure 3:
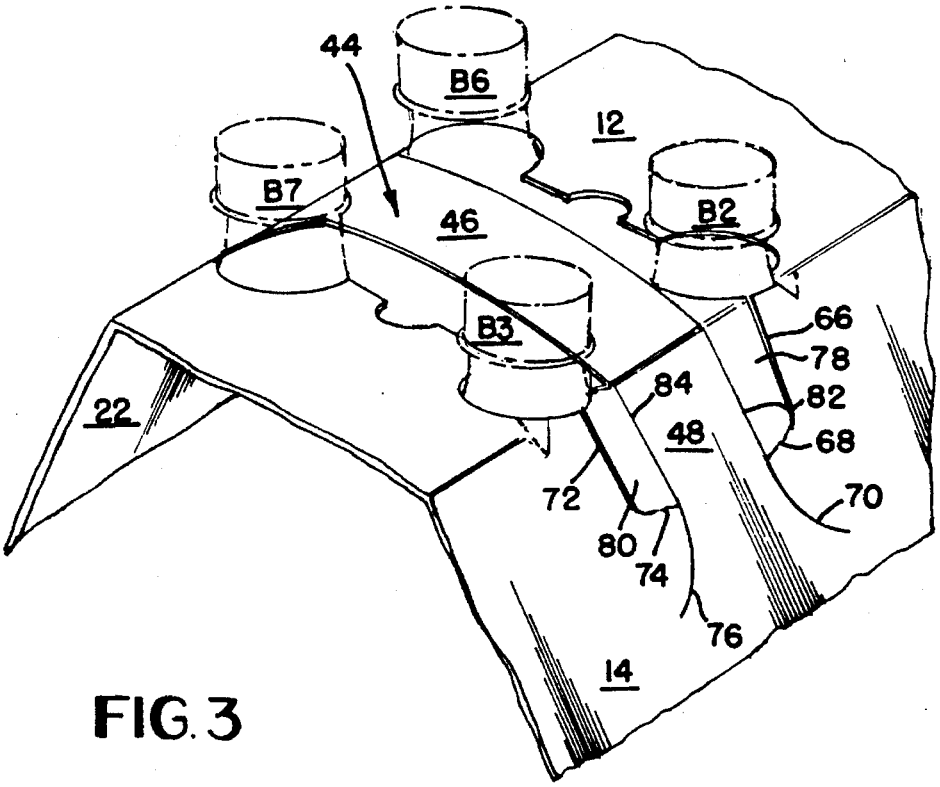
FIG. 3 is a fragmentary perspective view of the carton in FIG. 1, showing the handle in the condition wherein impact force has just been applied to the handle.
Figure 4:
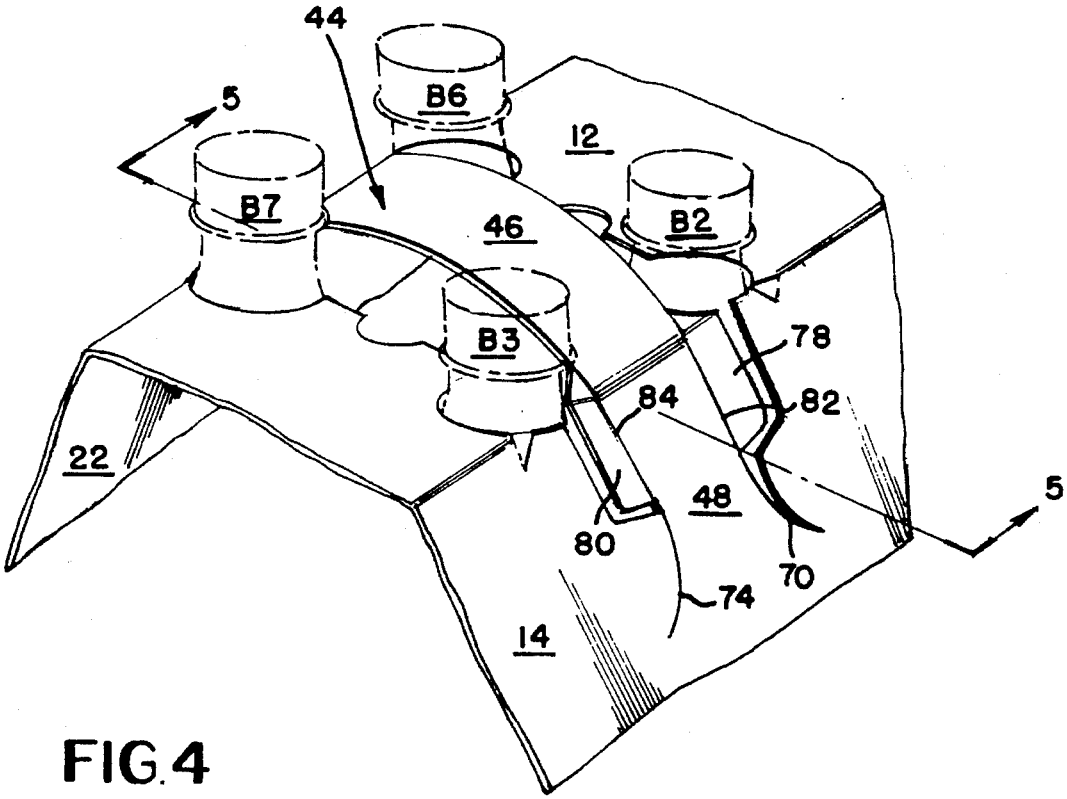
FIG. 4 is a fragmentary perspective view of the carton in FIG. 1, showing the handle in the condition wherein the intermediate portion of the handle is upwardly bowed and the end portions are displaced inwardly.

To lift and carry the carton of this invention, the fingers of a user are pressed against the cushion flaps 62 and 64 as shown in FIG. 1 and are inserted into the slots defined by the flaps 62 and 64. This causes the flaps 62 and 64 to be folded downwardly into the respective positions where they are disposed in flat face contacting relation with the inside surface of the central part 60 as best shown in FIG. 3. By this structure, the flap 62 and 64 effectively reinforce the handle 44 and affords cushions along the fold lines 56 and 58, which protects the hand of the user. The handle 44 is then gripped by the fingers and pulled upwards so that the carton 10 is lifted. When the handle 44 is first pulled, impact stress tends to be concentrated at around the lower ends of the upper slits 66, 72, 66*a* and 72*a* although stress is induced throughout the handle 44. Such concentrated stress causes tearing of the panels 14 and 22 along the tear lines 68, 74, 68*a* and 74*a*. This tearing delays the full impact force to reach any other portion of the handle 44; it prevents sudden substantial stress increase in any other portion of the handle 44. FIG. 3 shows the handle 44 in the condition wherein the upward pulling force has just been applied to the handle 44 but the panels 14 and 22 have not yet been torn whereas FIG. 4 shows the handle 44 in the raised position wherein the panels 14 and 22 have been torn along the tear lines and the intermediate portion 46 is upwardly bowed.

Figure 5:
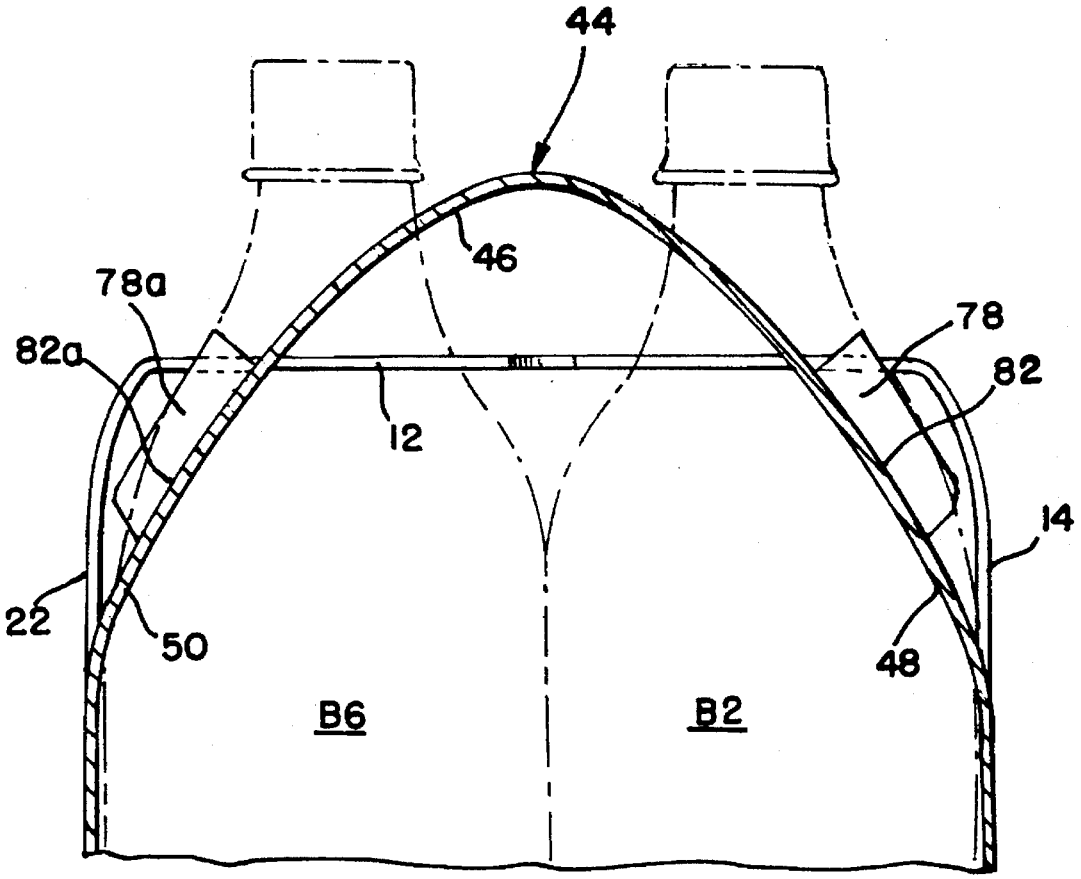
FIG. 5 is a view taken along the line V—V in FIG. 4.

Tearing along the tear lines 68, 74, 68*a* and 74*a* intercommunicates the upper slits 66, 72, 66*a* and 72*a* respectively with the lower slits 70, 76, 70*a* and 76*a*. This operation allows the end portions 48 and 50 of the handle 44 to be displaced inwardly of the carton 10 as the intermediate portion 46 is pulled and thus bowed upwardly as shown in FIG. 4. This displacement of the end portions causes the tabs 78, 80, 78*a* and 80*a* to be pressed against the bottles B2, B3, B6 and B7 and to thus be folded outwardly of the carton about the fold lines 82, 84, 82*a* and 84*a* as best shown in FIGS. 4 and 5. This folding movement of the tabs 78, 80, 78*a* and 80*a* allow the handle 44 to absorb the impact applied thereto when tearing along the tear lines 68, 74, 68*a* and 74*a* are completed. In other words, the impact force applied to the handle is used to gradually increase bending stress in the handle 44 around the fold lines 82, 84, 82*a* and 84*a* as the tabs 78, 80, 78*a* and 80*a* are folded. The handle 44 is thus prevented from being damaged by the pulling impact, and therefore the end portions 48 and 50 are fully displaced into the rooms, i.e., one room between the bottles B2 and B3 and the other room between the bottles B6 and B7, to provide an adequate hand room between the intermediate portion 46 and the top panel 12 as best shown in FIG. 5.

In the foregoing embodiment, the medial fold lines 56 and 58 are disposed in substantially tangential relation with the circular perimeters of the adjacent neck-receiving apertures 31, 35, 32 and 36 to allow the tabs 78, 80, 78*a* and 80*a* be separated from the cushion flaps 62 and 64. However, it should be recognized that in an arrangement wherein no neck-receiving aperture is employed, suitable separation means such as cuts and slits should be provided for the handle to separate the foldable tabs from the carton top panel or the cushion flaps. Such cuts and slits may be disposed along the joint between the top panel and each side panel or at any other location either in the top panel or in the side panels. Cartons having no neck-receiving aperture are disclosed for example in U.S. Pat. Nos. 4,784,266 and 5,151,488 which are owned by the assignee of the invention and which are hereby incorporated by reference. As suggested in these patents, the bottle neck-receiving apertures may be replaced by any end bottle retention means known in this art.

It should be also recognized that in the foregoing embodiment, the tear lines 68, 74, 68*a* and 74*a* are options and may be omitted.

Figure 6:
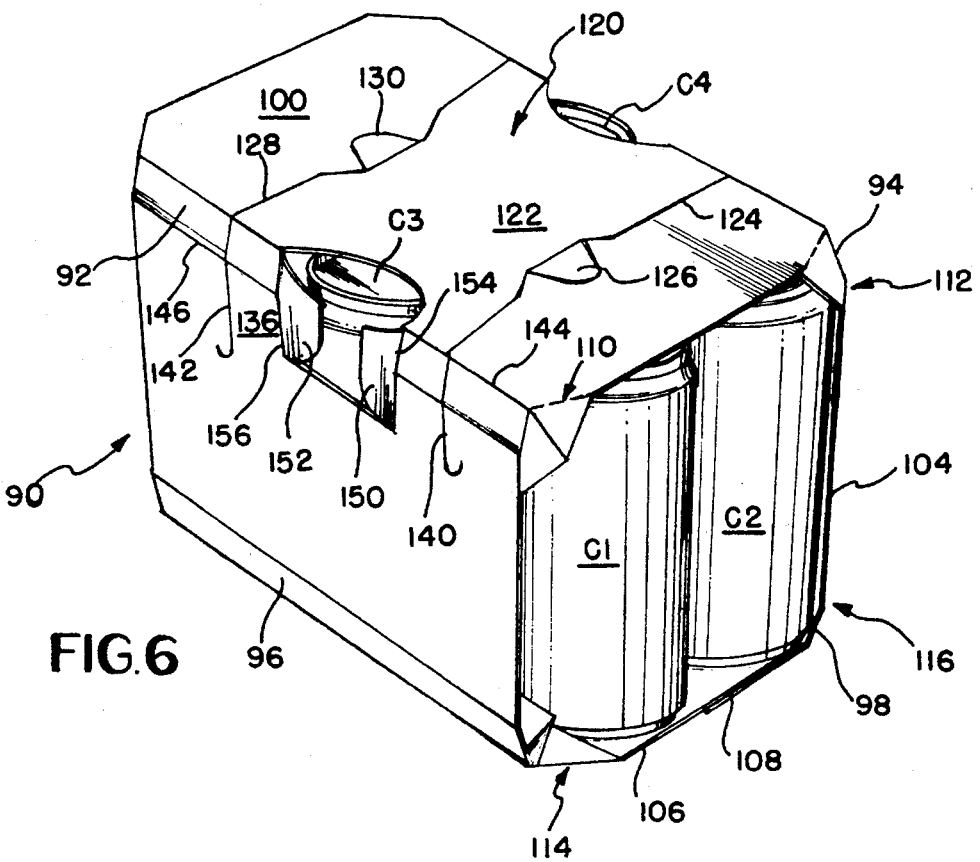
FIG. 6 is a perspective view of a can carton according to another embodiment of the invention.
Figure 7:
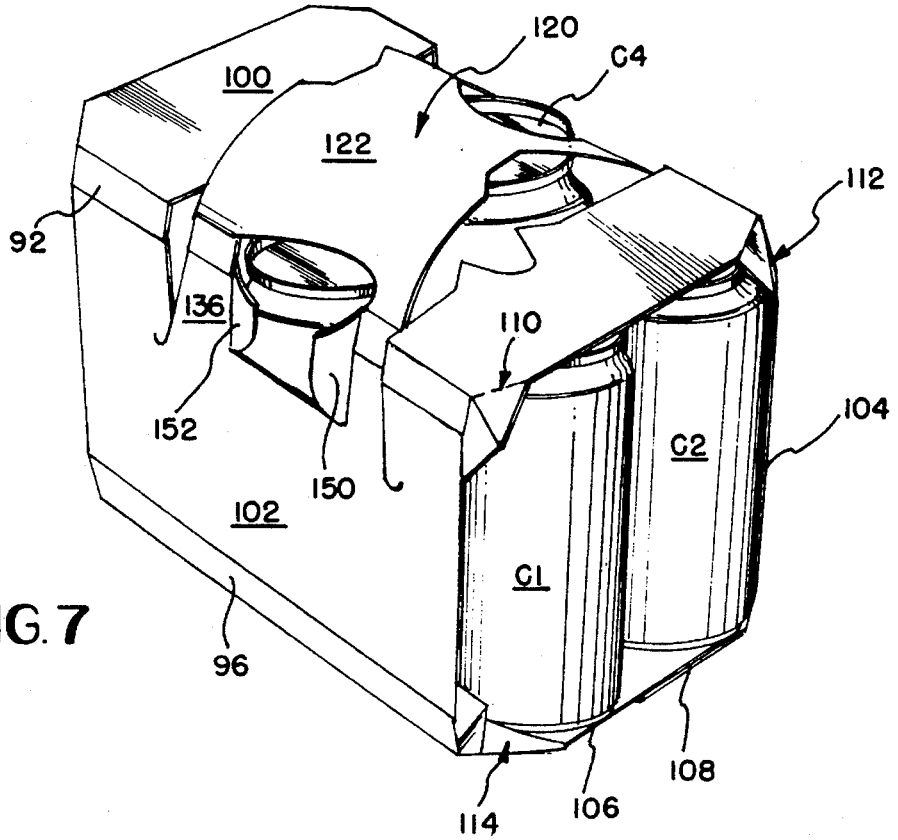
FIG. 7 is a perspective view of the carton in FIG. 7, showing the handle in the upwardly bowed condition.
Figure 8:
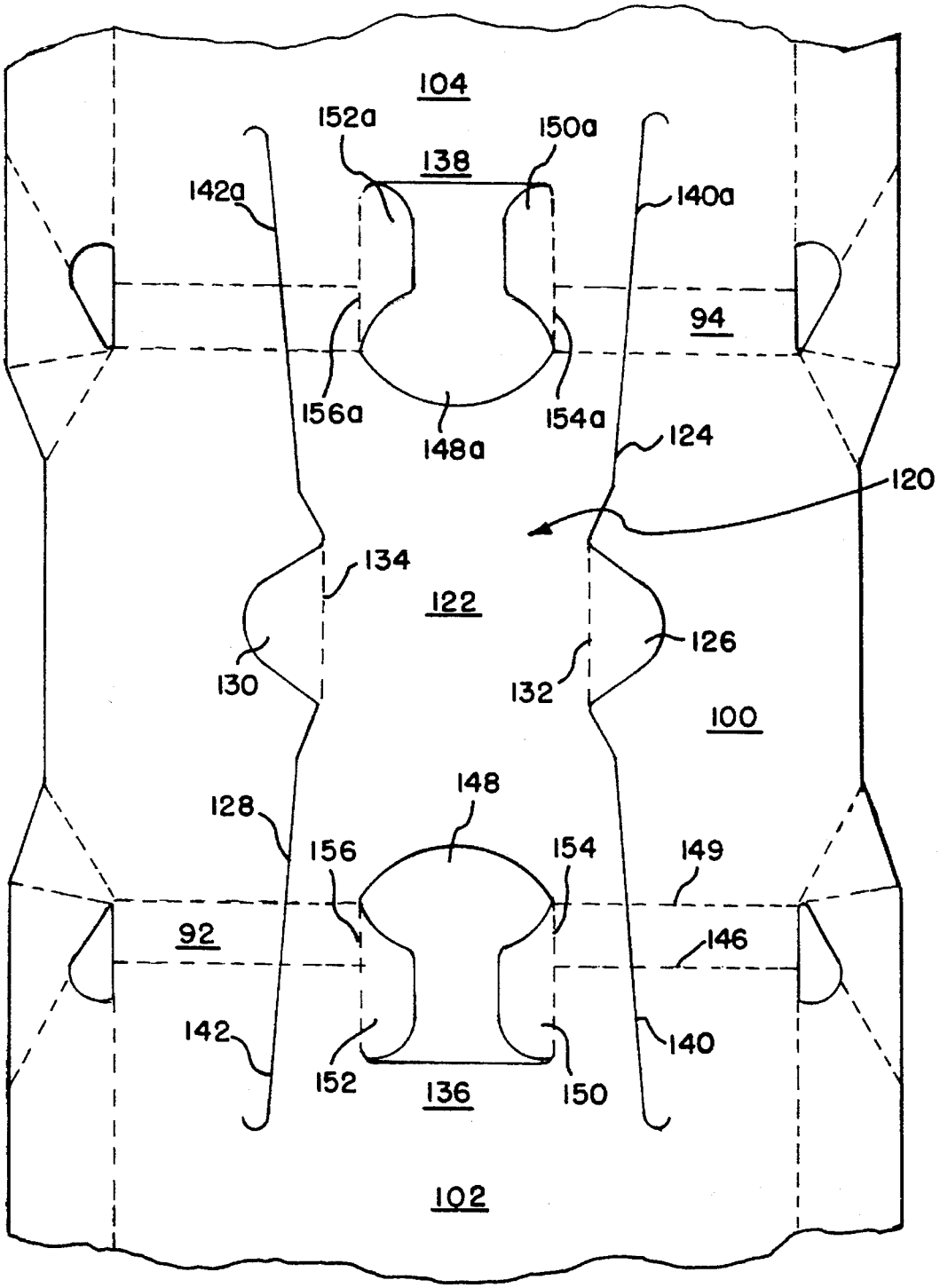
FIG. 8 is an enlarged plan view of a portion of the blank from which the carton in FIG. 6 is formed.

The present invention may also be applied to can cartons. One such example is shown in FIGS. 6–8 wherein the can carton 90 accommodates six cans arranged in two rows of three cans each. The carton 90 includes upper and lower sloping strips 92, 94, 96 and 98 in addition to the top panel 100, side panels 102 and 104 and the bottom lap panels 106 and 108, and also includes end retention means in the form of corner web structures 110, 112, 114 and 116. The details of the sloping strips and the corner web structures are described in U.S. Pat. No. 5,000,313 which is owned by the assignee of the invention and which is hereby incorporated by reference.

As best shown in FIG. 8, a transverse strap handle 120 is disposed astride the top panel 110 and both the upper sloping panels 92 and 94 and is joined at its opposite ends to the side panels 102 and 104 respectively. The location of the handle 120 is such that the handle 120 is disposed over two intermediate cans C3 and C4. The intermediate portion 122 is struck from the top panel 100 and is defined between a pair of spaced side edges. One of the side edges is defined by a slit 124 which includes the outer perimeter of a cushion flap 126 struck from the top panel 100. In like manner, the other side edge of the intermediate portion 122 is defined by a slit 128 including the outer perimeter of a cushion flap 130 struck from the top panel 100. The flaps 126 and 130 are foldably joined to the intermediate portion 122 along fold lines 132 and 134.

The end portion 136 of the handle 120 is struck in part from the side panel 102 and in part from the sloping panel 92. Likewise, the end portion 138 is struck in part from the side panel 104 and in part from the sloping panel 94. The end portion 136 is defined between a pair of slits 140 and 142 which extend downwardly as viewed in FIG. 6 from the fold line 144, intersect the fold line 146 and terminate at respective lower ends in the side panel 102. The lower ends of the slits 140 and 142 are curved outwardly and then upwardly toward the top panel 100. The slits 140 and 142 are disposed continuously with the slits 124 and 128 in the top panel 100.

The end portion 136 is formed with an aperture 148 for receiving the top portion of the intermediate can C3, and the foldable tabs 150 and 152 are joined to the perimeter of the aperture 148 along fold lines 154 and 156. These tabs 150 and 152 are formed of material struck from the end portion 136 to form the aperture 148. Because the end portions 136 and 138 are of a virtually identical construction, description of the end portion 138 is omitted and the parts of the portion 138 similar to the parts of the portion 136 are identified in FIG. 8 by the same reference numerals with the subscript "a".

In use, the flaps 126 and 130 are folded downwardly into the respective positions under the intermediate portion 122 and then the handle 120 is pulled upwards. This allows the end portions 136 and 138 to be moved inwardly of the carton 90 as the intermediate portion 122 is bowed upwardly as shown in FIG. 7. This operation causes the top portions of the cans C3 and C4 to be received in the apertures 148 and 148*a* and thus causes the tabs 150, 152, 150*a* and 152*a* to be pressed against the cans C3 and C4. The pressed tabs are folded outwardly about the fold lines 154, 156, 154*a* and 156*a* and thereby absorb the pulling impact to the handle 120.

Figure 9:
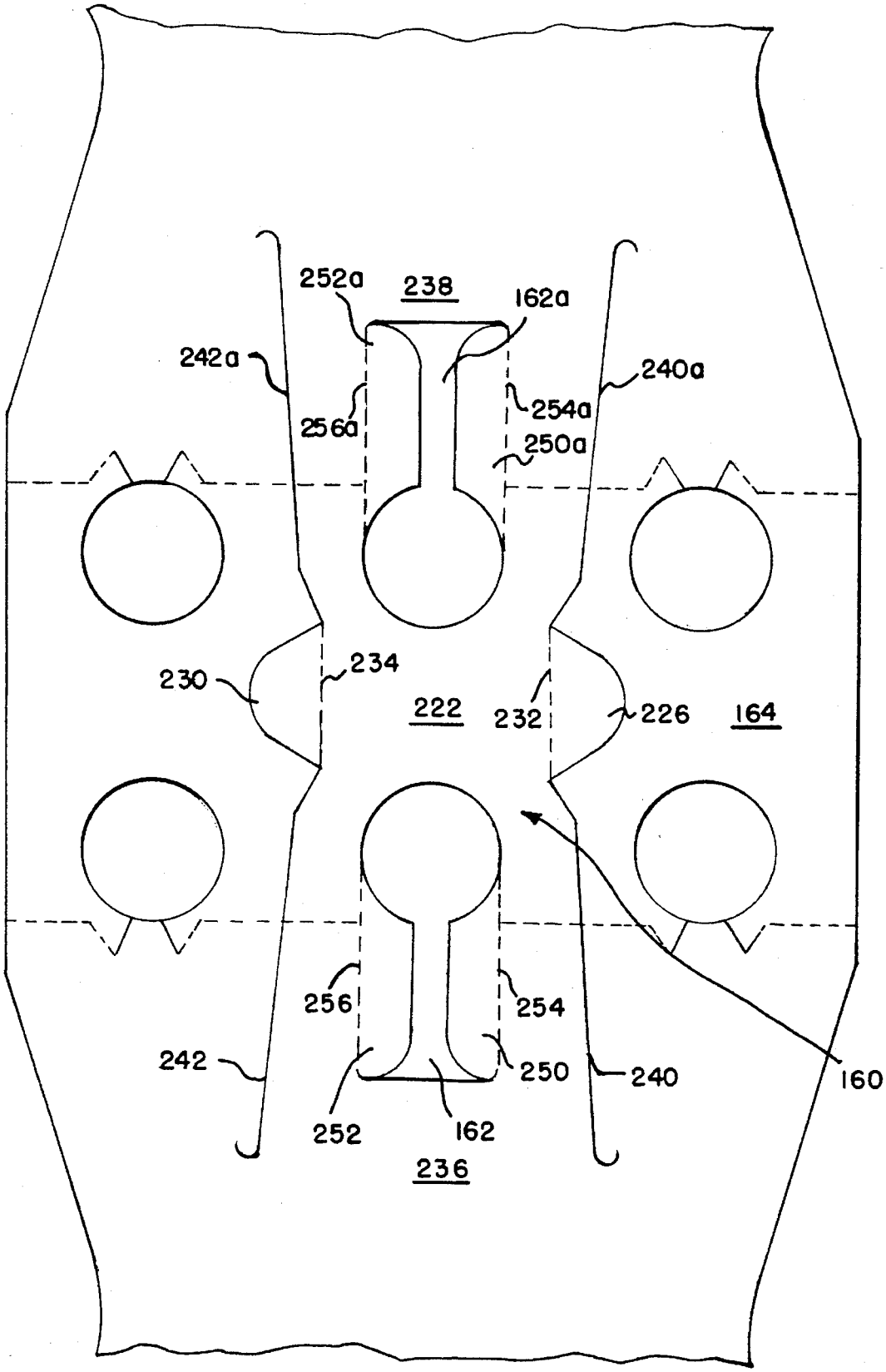
FIG. 9 is a plan view of a portion of the blank from which a carton according to a further embodiment is formed.

It should be recognized that the invention may also be used with bottle cartons containing an odd number (e.g., three) of bottles in each row. FIG. 9 shows a bottle carton having a handle 160 similar to the handle 120 In FIG. 8, in which the apertures 162 and 162*a* in the handle end portions 236 and 238 are formed such that they are open respectively to the intermediate bottle neck-receiving apertures in the top panel 162. The remainder of the handle 160 is virtually identical to the handle 120 in FIG. 8 and thus description thereof is omitted. Those portions of the handle 160 in FIG. 9 identical to the handle 120 are denoted by similar references which are larger by one hundred than the corresponding references used in FIG. 8.

It should be also recognized that the invention may be used with any number of articles for each row, and may also be used for article arrangements having one row or greater than two rows.

What is claimed is:

1. A carton comprising:

a top panel having a pair of opposite side edges;

a pair of side panels foldably joined to and extending downwardly from said side edges of said top panel; and a strap handle formed in part from said top panel and in part from said side panels, said handle extending transversely across said top panel and being joined at opposite end portions thereof respectively to said side panels for movement between a stowed position where an intermediate portion of said handle is disposed in a plane of said top panel and a raised position where said intermediate portion is bowed and disposed above said top panel whereby said end portions of said handle are moved inwardly of said carton when said handle is moved from said stowed position to said raised position, each of said end portions having foldable means adapted to be pressed against an article within said carton and to thereby be folded to allow gradual stress increase in said handle when said handle is moved from said stowed position toward said raised position, said foldable means of said each end portion comprising a tab formed from adjacent one of said side panels and joined to said each end portion along a fold line for outward folding movement about said fold line upon movement of said strap handle toward said raised position, said fold line extending transversely of adjacent one of said side edges of said top panel.

2. The carton according to claim 1, wherein said intermediate portion of said strap handle is defined between a pair of opposed first slits formed in said top panel, said first slits extending between said side edges of said top panel, said each end portion of said strap handle is defined between a pair of opposed second slits formed in adjacent one of said side panels, said second slits extending generally downwardly from adjacent one of said side edges of said top panel, and said second slits in each of said side panels are continuous respectively with said first slits.

3. The carton according to claim 2, wherein said tab of said each end portion is defined between said fold line in said each end portion and one of said second slits in adjacent one of said side panels.

4. The carton according to claim 3, wherein said each side panel is provided with a pair of third slits disposed at a lateral space respectively from said second slits in said each side panel, said third slits extending to respective lower ends remoter from adjacent one of said side edges than lower ends of said second slits in said each side panel, and said lower ends of said second slits in said each side panel are curved so as to be directed respectively to said third slits in said each side panel.

5. The carton according to claim 4, wherein said each side panel is provided with a pair of tear lines extending respectively from said lower ends of said second slits in said each side panel to said third slits in said each side panel.

6. The carton according to claim 4 wherein said lower ends of said third slits in said each side panel are arcuately curved.

7. The carton according to claim 4, wherein said fold line in said each end portion extends downwardly from adjacent one of said side edges of said top panel to an upper end of one of said third slits in adjacent one of said side panels.

8. The carton according to claim 3, wherein said top panel is provided with an aperture for receiving a top portion of said article, and at least one of said first slits includes a part of a perimeter of said aperture.

9. The carton according to claim 2, wherein said each end portion of said strap handle has an aperture for receiving a top portion of said article, and said tab of said each end portion is formed of material struck from said each end portion to form respective one of said apertures and is foldably joined to said each end portion along a perimeter of said respective aperture.

10. The carton according to claim 2, wherein said strap handle has a pair of cushion flaps struck from said top panel and foldably joined to said intermediate portion, and said first slits include outer perimeters of said cushion flaps.

11. A package comprising:

a plurality of articles arranged into a group of at least one row, each of said articles having a top and a substantially rounded side wall defining a center axis, said axes of said articles in said group being disposed vertically and parallel to each other; and a carton disposed around the exterior of said group of said articles and comprising a top panel, a pair of side panels and a strap handle, said side panels being disposed adjacent to said side walls of said articles in said group along opposite sides of said group, said top panel being disposed adjacent to said tops of said articles in said group, said strap handle formed in part from said top panel and in part from said side panels, said handle extending transversely across said top panel and being joined at opposite end portions thereof to said side panels respectively, at least a part of each of said end portions being located midway between two adjacent ones of said articles in said group so as to allow said each end portion to move inwardly of said carton when said handle is pulled upward from a stowed position where an intermediate portion of said handle is disposed in a plane of said top panel, said each end portion having foldable means adapted to be pressed against said side wall of at least one of said two adjacent articles and to thereby be folded to allow gradual stress increase in said handle when said handle is pulled upwards from said stowed position, said foldable means of said each end portion comprising a tab formed from adjacent one of said side panels and foldably joined to said each end portion, said tab being disposed flush with said adjacent side panel when said handle is in said stowed position, wherein said tab of said each end portion is joined to said each end portion along a fold line for outward folding movement about said fold line upon upward movement of said strap handle, said fold line extending transversely of adjacent one of said side edges of said top panel.

12. The package according to claim 11, wherein said top panel has a pair of side edges, said side panels are foldably joined to and extending downwardly from said side edges of said top panel, said intermediate portion of said strap handle is defined between a pair of opposed first slits formed in said top panel, said first slits extending between said side edges of said top panel, said each end portion of said strap handle is defined between a pair of opposed second slits formed in adjacent one of said side panels, said second slits extending generally downwardly from adjacent one of said side edges of said top panel, and said second slits in each of said side panels are continuous respectively with said first slits.

13. The package according to claim 12, wherein said tab of said each end portion is defined between said fold line in said each end portion and one of said second slits in adjacent one of said side panels.

14. The package according to claim 12, wherein said each end portion of said strap handle has an aperture for receiving a top portion of adjacent one of said articles in said group, and said tab of said each end portion is formed of material struck from said each end portion to form respective one of said apertures and is foldably joined to said each end portion along a perimeter of said respective aperture.

15. A carton comprising:

a top panel having a pair of opposite side edges;

a pair of side panels foldably joined to and extending downwardly from said side edges of said top panel; and a strap handle formed in part from said top panel and in part from said side panels, said handle extending transversely across said top panel and being joined at opposite end portions thereof respectively to said side panels, an intermediate portion of said handle being defined between a pair of opposed first slits formed in said top panel, each of said end portions of said handle being defined between a pair of opposed second slits formed in adjacent one of said side panels, said second slits in each of said side panels being continuous respectively with said first slits and extending generally downwardly from adjacent one of said side edges of said top panel, said each side panel being provided with a pair of third slits disposed at a lateral space respectively from said second slits in said each side panel, said third slits extending to respective lower ends remoter from adjacent one of said side edges of said top panel than lower ends of said second slits in said each side panel, said lower ends of said second slits in said each side panel being curved so as to be directed respectively to said third slits in said each side panel whereby when said handle is pulled upward, each of said second slits tends to tear into adjacent one of said third slits.

16. The carton according to claim 15, wherein said each side panel is provided with a pair of tear lines extending respectively from said lower ends of said second slits in said each side panel to said third slits in said each side panel.

17. The carton according to claim 15 wherein said lower ends of said third slits in said each side panel are arcuately curved.

18. A blank for forming a carton, comprising a top panel having a pair of opposite side edges, and a pair of side panels foldably joined to said side edges of said top panel, said top panel having a pair of opposed first slits extending across said top panel transversely of said side edges, each of said side panels having a pair of opposed second slits disposed transversely of said side edges of said top panel, said second slits in said each side panel being disposed continuously respectively with said first slits and extending from adjacent one of said side edges away from said first panel whereby a portion of said top panel between said first slits and respective portions of said side panels between said second slits comprise a continuous length of strap handle, said each side panel being provided with a pair of third slits disposed at a lateral space respectively from said second slits in said each side panel, said third slits extending to respective outward ends remoter from adjacent one of said side edges of said top panel than outward ends of said second slits in said each side panel, said outward ends of said second slits in said each side panel being curved so as to be directed respectively to said third slits in said each side panel.

19. The blank according to claim 18, wherein said each side panel is provided with a pair of tear lines extending respectively from said outer ends of said second slits in said each side panel to said third slits in said each side panel.

20. The blank according to claim 18 wherein said outer ends of said third slits in said each side panel are arcuately curved.

* * * * *